US005417166A

United States Patent [19]

Credle, Sr.

[11] Patent Number: 5,417,166

[45] Date of Patent: May 23, 1995

[54] PORTABLE UMBRELLA TABLE

[76] Inventor: Michael T. Credle, Sr., 891 Switchback Rd., Christiansburg, Va. 24073

[21] Appl. No.: 262,641

[22] Filed: Jun. 20, 1994

Related U.S. Application Data

[63] Continuation of Ser. No. 35,401, Mar. 22, 1993, abandoned.

[51] Int. Cl.[6] ..... A47B 35/00

[52] U.S. Cl. ..... 108/50; 108/150; 248/156

[58] Field of Search ..... 108/50, 150, 51; 135/16; 248/156

[56] References Cited

U.S. PATENT DOCUMENTS

| | | | |
|---|---|---|---|
| 1,218,357 | 3/1917 | Bauer | 248/156 X |
| 2,575,890 | 10/1950 | Gage | 248/156 X |
| 2,877,828 | 3/1959 | Barnette, Jr. | 248/156 X |
| 3,182,936 | 5/1965 | Murdock . | |
| 4,524,533 | 6/1985 | Still, Jr. | 248/156 X |
| 4,625,656 | 12/1986 | Brickman | 108/25 |
| 4,896,651 | 1/1990 | Kott, Jr. | 248/156 X |
| 4,920,897 | 5/1990 | Reed et al. | 108/150 |
| 5,055,081 | 10/1991 | Nayak | 108/26 X |
| 5,076,175 | 12/1991 | Waatley, II | 108/51.1 |
| 5,090,348 | 2/1992 | Hugron . | |
| 5,122,014 | 6/1992 | Genfan | 248/156 X |

FOREIGN PATENT DOCUMENTS

| | | | |
|---|---|---|---|
| 465880 | 6/1950 | Canada | 108/150 |

*Primary Examiner*—Jose V. Chen

[57] ABSTRACT

A portable umbrella table is easily assembled and is affixed to the ground by a central hollow stake. The umbrella includes a shaft which is joined to a post which slides through the hollow stake into the ground to provide additional security and stability to table during wind gusts. Adjustable straps are provided on the bottom surface of the table top to laterally contain the umbrella against the table top for transportation and storage and a table top handle allows one person to easily transport the umbrella table before and after use.

4 Claims, 1 Drawing Sheet

PORTABLE UMBRELLA TABLE

This is a continuation of application Ser. No. 08/035,401, filed Mar. 22, 1993, now abandoned.

BACKGROUND OF THE INVENTION

1. Field of the Invention

The invention herein relates to a table for outdoor use and particularly for use on beaches, lawns or other places which will allow the table stake to be driven into the ground.

2. Description of the Prior Art and Objectives of the Invention

Swimmers, sunbathers and the like in recent years have developed a desire for a table to be used at lakes, beaches and the like which can be easily transported to and from their vehicles and which can be easily assembled and disassembled after use. Conventional pool or lawn furniture is suitable for permanent locations but cannot be easily moved or handled by an individual. Conventional umbrella tables are quite popular but generally require two or more people to set them up and transport them to a desired location at the beach. U.S. Pat. No. 2,190,222 demonstrates an earlier attempt at a collapsible or portable umbrella table and a more recent portable table is set forth in U.S. Pat. No. 4,920,897. Pat. No. 2,190,222 is supported by a single rod driven into the ground whereas U.S. Pat. No. 4,920,897 provides an auger which is screwed into the ground to maintain it in place, Neither of these prior art devices can be easily packed as a single unit for manual carrying by an individual and no provisions are made for conveniently holding valuables while the table is located in a windy environment.

Thus with these and other problems and disadvantages of conventional portable umbrella tables, the present invention was conceived and one of its objectives is to provide an attractive, lightweight portable umbrella table which can be quickly assembled and positioned for use or disassembled in a matter of minutes by a single individual.

It is another objective of the present invention to provide a portable umbrella table which can be packed on itself and easily carried in one hand by an adult which allows freedom for the other hand for carrying a child or other items.

It is yet another objective of the present invention to provide a portable umbrella table which includes a storage compartment for safely maintaining valuables during periods of wind gusts.

It is still another objective of the present invention to provide a portable beach table in which the table top includes a rigid strip for use as a hammer during set up.

It is yet still another objective of the present invention to provide a table top which includes adjustable straps for laterally placing the umbrella thereagainst during periods of storage or transportation.

Various other objectives and advantages of the present invention will become apparent to those skilled in the art as a more detailed explanation is set forth below.

SUMMARY OF THE INVENTION

The present invention provides a portable umbrella table for use on beaches or the like and includes a table stake which can be driven into the soil or sand by striking the top of the stake with the reinforced rigid edge of the table top. Once the stake has been driven into the ground the table top is then placed over the stake by fitting the stake into a socket on the bottom surface of the table top. Directly above the socket is an umbrella post opening whereby an umbrella post, after attachment to the umbrella, can be passed through the post opening, through the hollow stake and into the ground to provide additional stability and security, even during periods of high winds. A convenient storage pocket is provided immediately below an opening in the table top for maintaining articles of value such as keys, change or other items which may be easily blown from the table and lost. A handle is positioned within the table top for gripping during transportation and for holding while driving the table stake into the ground. Adjustable straps are positioned on the underneath or bottom side of the table top to maintain the umbrella table stake, umbrella and umbrella post thereagainst for carrying purposes.

DESCRIPTION OF THE PREFERRED EMBODIMENT

Figure 1:
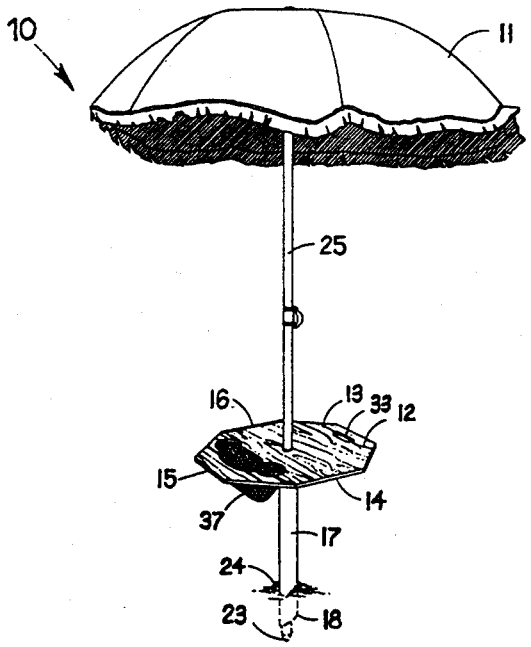
FIG. 1 demonstrates the portable table of the invention shown fully assembled and positioned in the ground.
Figure 3:
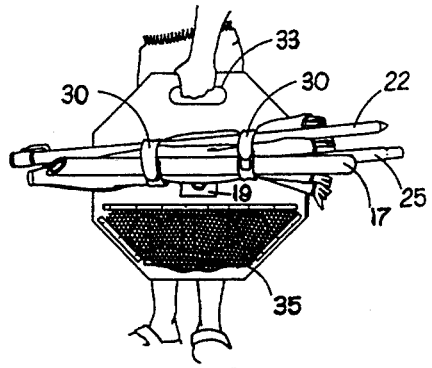
FIG. 3 shows the portable umbrella table in a compact storage mode as being carried.
Figure 2:
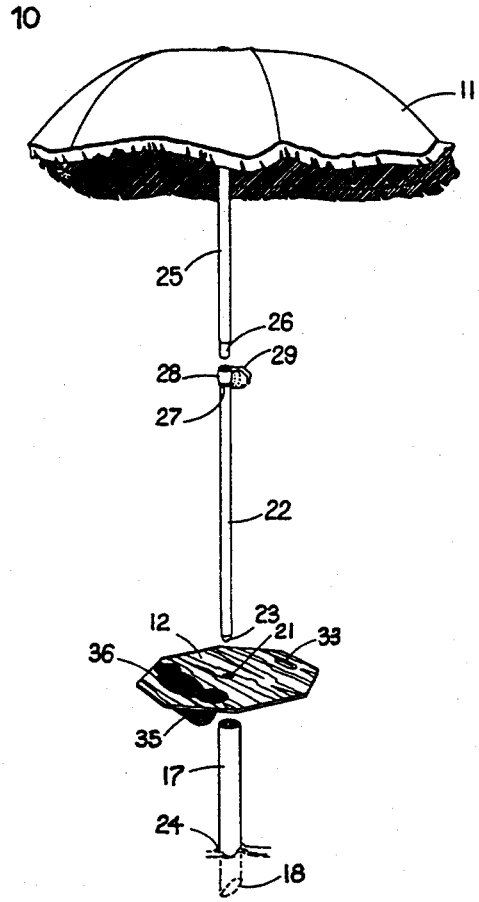
FIG. 2 illustrates an exploded view of the invention to better illustrate the parts thereof.
Figure 4:
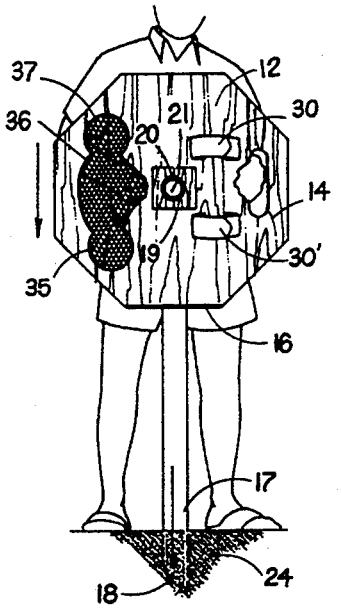
FIG. 4 demonstrates the table top used to drive table post 17 into the soil.
Figure 5:
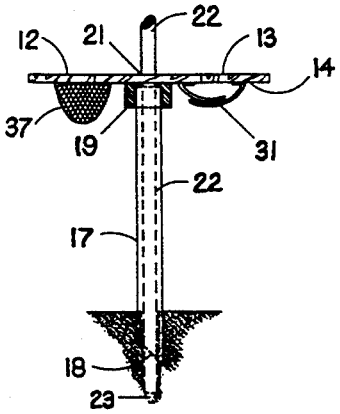
FIG. 5 demonstrates a cross-sectional view of a portion of the portable umbrella table during assembly.

The preferred form of the invention is depicted in FIGS. 1–5 whereby portable umbrella table 10 as shown in FIG. 1 is fully assembled and in place and in FIG. 3 has been disassembled and is compactly stored for transportation purposes. In FIG. 2, the umbrella is affixable to an extension post which will pass through the centrally located post opening in the table top and as shown in FIG. 5, passes through the center of the table stake and thereafter into the soil for stability. When stored as shown in FIG. 3, the umbrella, umbrella post and table stake are laterally affixed to the bottom surface of the table top by two adjustable straps attached thereto. A handle is formed at one edge of the table for ease and convenience in carrying and for hammering the table stake into the ground as shown in FIG. 4. The table top is octagonal in shape and includes a reinforced edge by the use of hard, rigid strip positioned along a portion of the edge and said rigid strip may be made of a hard, durable plastic. A nylon mesh pocket is affixed to a somewhat U-shaped opening in the table top to maintain keys or other valuables therein and the ends of the substantially U-shaped opening are circular to maintain soft drink cans in an upright position such as when the table is accidentally bumped or during periods of wind gusts.

DETAILED DESCRIPTION OF THE DRAWINGS AND OPERATION OF THE INVENTION

For a better understanding of the invention, turning now to the drawings, FIG. 1 illustrates portable umbrella table 10 having an umbrella 11 and a table top 12. Table top 12 which may be formed from wood or plastic includes an upper surface 13, a bottom surface 14 and a surrounding edge 15. Attached to surrounding edge 15 along one section is a hard, rigid strip 16 which may be formed from metal, hard plastic or other durable materials. Strip 16 can be used somewhat as a hammer or mallet as shown in FIG. 4 whereby table top 12 is used to drive table stake 17 into the ground by manually striking stake 17 with rigid strip 16. Rigid strip 16 protects edge 15 as top 12 may be formed from wood or other less durable materials. As shown in FIGS. 1, 2, 4 and 5, stake 17 consists of a hollow pipe or tube which might for example, be formed with terminal beveled distal end 18 to allow penetration into sand or soil with ease. Stake 17 may have an outer diameter of approximately two to three inches and is sized to snugly fit within block 19 which is affixed to bottom surface 14 of table top 12 and provides means for defining stake socket 20 as shown in FIG. 4. Stake socket 20 is sized to snugly accept the outer diameter of stake 17 and as further shown in FIG. 4 is coincidental with umbrella post opening 21. Umbrella post opening 21 is centrally defined by table top 12 and allows umbrella post 22 as seen in FIG. 5 to pass through table top 12 into table stake 17 where, as shown in FIG. 1, pointed end 23 penetrates sand or soil 24. Thus, umbrella 11 with umbrella shaft 25 is joined to umbrella post 22 as reduced shaft end 26 engages upper umbrella post end 27 and is held in place as clamp band 28 is tightened by handle 29, as depicted in FIG. 2. Releasing clamp 28 by raising handle 29 allows umbrella shaft 25 to be easily removed from umbrella post 22. Umbrella post 22 can be slidably withdrawn from stake 17 and table top 12, after which table top 12 can be lifted from stake 17. After urging stake 17 from soil 24 a convenient carrying configuration is provided by the use of nylon straps 30, 30' as shown in FIG. 3. Straps 30, 30' are adjustably tightenable through the use of buckles (not shown), hook and loop fasteners 31 as shown in FIG. 5 or other conventional methods. Another means for maintaining an umbrella laterally across table top 12 may consist of a pair of rigid L-shaped brackets (not shown) which may be affixed to bottom surface 14 of table top 12 in place of straps 30, 30'. Openings in table top 12 to accommodate beverage cans could be directly above said L-shaped brackets so that said brackets will maintain an umbrella in a storage position as seen in FIG. 3, yet when the table is set up as in FIG. 1, the brackets provide a stop or rest for the beverage cans placed in the openings.

As additionally seen in FIG. 2, handle 33 which is defined by table top 12 allows portable umbrella table 10 to be easily carried. In FIG. 4, handle 33 provides a means to grip table top 12 when driving stake 17 into the sand or soil 24.

On the beach and at other outdoor locations, continual wind will oftentimes prevent lightweight articles, papers and the like from remaining on table top 12. Therefore, as seen in FIG. 4, storage compartment 35 is provided as table top 12 defines a somewhat U-shaped opening 36 therein and mesh pocket 37 is attached to bottom surface 14 immediately below opening 36. Pocket 37 may consists of a nylon mesh having an opening size of one-quarter inch or less to hold various small articles of value.

Portable umbrella table 10 is relatively light in weight, weighing approximately thirteen pounds and can be carried and set up by an individual on a beach or the like in less than five minutes. Once in place, table 10 will remain stationary even in strong winds and can be used to conveniently hold valuables while swimming or engaged in other activities. After use, by simply reversing the assembly steps the table can be quickly disassembled and manually carried to a vehicle for storage in the vehicle trunk until the next outing.

The illustrations and examples provided herein are for explanatory purposes and are not intended to limit the scope of the appended claims.

I claim:

1. A portable umbrella table comprising: (a) a table top, said table top defining a centrally located umbrella post opening; (b) means for defining a stake socket coincidental with the umbrella post opening, said stake socket defining means attached to a bottom surface of said table top; (c) a hollow stake having a distal end for penetrating a substrate and the other end accepted within the stake socket; (d) means for driving said hollow stake into said substrate, said stake driving means comprising a hard, rigid strip attached to one side of said table top, (e) an umbrella post, said umbrella post positioned through said umbrella post opening and passing through and beyond said hollow stake for penetrating into the substrate; and (f) an umbrella joined to said umbrella post.

2. The portable umbrella table as defined in claim 1, wherein said table top defines a handle and a storage compartment opening, the handle proximate an edge perpendicular to said stake driving means, and the storage compartment proximate another edge perpendicular to said stake driving means.

3. The portable umbrella table as defined in claim 1, further comprising a pocket attached to said table top beneath the storage compartment opening.

4. The portable umbrella table as defined in claim 1, further comprising an umbrella shaft joining said umbrella to said umbrella post.

* * * * *